US006527475B1

(12) United States Patent
Lowrie

(10) Patent No.: US 6,527,475 B1
(45) Date of Patent: Mar. 4, 2003

(54) QUICK STOP DEPLOYMENT SYSTEM AND METHOD

(76) Inventor: David F. Lowrie, 3249 Riverside Dr., Port Huron, MI (US) 48060

( * ) Notice: Subject to any disclaimer, the term of this patent is extended or adjusted under 35 U.S.C. 154(b) by 0 days.

(21) Appl. No.: 09/658,809

(22) Filed: Sep. 11, 2000

(51) Int. Cl.[7] ..... E01F 13/04

(52) U.S. Cl. ..... 404/6; 404/9; 180/287; 256/1; 256/13.1

(58) Field of Search ..... 404/6, 9; 180/287; 256/1, 13.1

(56) References Cited

U.S. PATENT DOCUMENTS

| | | | | |
|---|---|---|---|---|
| 5,253,950 | A | | 10/1993 | Kilgrow et al. |
| 5,330,285 | A | | 7/1994 | Greves et al. |
| 5,406,251 | A | * | 4/1995 | Leis |
| 5,498,102 | A | * | 3/1996 | Bissell |
| 5,611,408 | A | | 3/1997 | Abukhader |
| 5,645,296 | A | | 7/1997 | Okada et al. |
| 5,820,293 | A | | 10/1998 | Groen et al. |
| 5,839,849 | A | | 11/1998 | Pacholok et al. |
| 6,048,128 | A | * | 4/2000 | Jones, III et al. |

FOREIGN PATENT DOCUMENTS

| | | | | |
|---|---|---|---|---|
| FR | 002605655 A1 | * | 4/1988 | |
| FR | 002714404 A1 | * | 6/1995 | ..... E01F/13/04 |
| FR | 2714404 | * | 6/1995 | |
| GB | 000503906 A1 | * | 9/1992 | ..... E01F/13/00 |

OTHER PUBLICATIONS

1963 Aston Martin DB5 car used in the movies "Goldfinger" and "Thunderball" and described in the internet brochures from http://sturtevant.com/reed/db5–007d.jpg.*

1963 Aston Martin DB5 car used in the movies "Goldfinger" and "Thunderball" described in the internet brochures from www.cybersteering.com/trimain/famous/jbc.html.*

Magnum Spike!™ Brochure, as of May 2001.*

* cited by examiner

*Primary Examiner*—David Bagnell
*Assistant Examiner*—Kathy Mitchell
(74) *Attorney, Agent, or Firm*—Young & Basile

(57) ABSTRACT

A system for the selective deployment of a tire deflation device. The system incorporates the use of a mounted housing combined with a compressed gas propulsion source for ejecting a collapsed tire deflation device that is attached to the housing with a tether line. One embodiment of the invention is to have a dual system mounted to the underside of a vehicle behind the rear tires. Each system is pointed in an opposite direction to achieve left or right side deployment. A set of control switches mounted inside the vehicle near the operator can be depressed for either left or right side ejection. Upon ejection the tire deflation device projects laterally away from the vehicle. A remote trigger is disclosed.

18 Claims, 7 Drawing Sheets

QUICK STOP DEPLOYMENT SYSTEM AND METHOD

FIELD OF THE INVENTION

This invention relates to devices for disabling target vehicles by deflating one or more tires thereof, and more specifically to systems for storing and deploying tire deflators from both stationary and mobile positions.

BACKGROUND OF THE INVENTION

Numerous devices have been invented to deflate the tires of a motor vehicle by placing upwardly-extending metal spikes in the path of the vehicle. Such devices can be used by law enforcement officers to stop or slow target vehicles.

One such device is disclosed in U.S. Pat. No. 5,253,950 to Donald Kilgrow et al, issued Oct. 19, 1993. This device comprises a tire deflator which can be extended from a collapsed condition to place an array of upwardly extending metal spikes over a section of roadway from approximately 10 to 25 feet wide.

Other devices using spikes or the like are disclosed in U.S. Pat. Nos. 5,330,285 and 5,820,293.

These and similar devices are typically deployed by hand; i.e. they are carried to a site where the target vehicle is expected and placed in the roadway in the hope that the vehicle will drive over the extended spikes.

Another approach is taken to deal with a target vehicle which is being directly pursued. In dealing with this problem, several devices have been invented that can at least in theory, be used to disable target vehicles. U.S. Pat. 5,839,849 issued on Nov. 24, 1998 to David R. Pacholok and Charles A Kuecker describes a mechanical tire deflating device which is deployed by ejection forwardly from the front of a pursuing vehicle to a position beneath a second vehicle immediately in front of the law enforcement vehicle. According to the patent, a folded tire deflator is deployed forwardly of the law enforcement vehicle by a spring loaded launcher mounted on the front of the law enforcement vehicle. The deflator carries spikes which penetrate the tires of the target vehicle.

U.S. Pat. 5,611,408 issued on Mar. 18, 1997 to Saleem A. Abukhader describes another vehicle disabling device. The patent discloses a folded tire deflating device that is deployed from a launcher mounted on the underside of the front of a law enforcement vehicle. Upon deployment spikes are extended in such a way as to penetrate the tires of a target vehicle. A laser beam is used to aim the tire deflator. Both the Pacholok et al and Abukhader devices pose a threat that the pursuing vehicle will run over the tire deflator which has been deployed from it.

SUMMARY OF THE INVENTION

An object of my invention is to provide a system for effectively and quickly deploying a tire deflator into the path of a target vehicle. According to the apparatus aspect of my invention, a tire deflator device is stored in a housing in a deployable condition and orientation relative to a roadway over or by which a target vehicle is expected to pass. As the target vehicle approaches, a triggering system is used to actuate a power deployment system to eject the device from the housing substantially laterally across and onto the roadway ahead of the target vehicle. The device is tethered so as to limit the distance it will travel from the housing.

In one embodiment, the housing with the deflator stored therein is mounted to a law enforcement vehicle in such a way that the deflator device can be selectively ejected and/or deployed laterally of the law enforcement vehicle into the path of a target vehicle located behind and adjacent the law enforcement vehicle; i.e., in the adjacent lane but traveling in the same direction. This embodiment may incorporate two deflators, one for deployment to the left and another for deployment to the right. Either way, the deflator is safely behind the law enforcement vehicle and cannot be run over by the law enforcement vehicle as is the case with the prior art devices described above. The triggering system is preferably of the type incorporating a degree of redundancy, i.e., two switches or buttons which must be operated together or in sequence to prevent inadvertent or premature actuation.

In a second embodiment, my deployment system is mounted in a stationary structure, such as a toll booth or other station that is located beside a roadway. The housing for the tire deflation device is located at or just above road level and is ejected and/or deployed horizontally across the roadway into the path of an oncoming vehicle.

In all embodiments, the deflator device I prefer is of the type disclosed in the Kilgrow et al patent identified above; i.e., a deflator which can be collapsed for storage and expanded to considerable length when put into action. With a device of this type, it is desirable but not essential to use a tether which provides an intermediate resistance force before it extends to full length thereby to help to extend the deflator as it is deployed. This can be achieved in various ways. For example, a coiled tether may be stitched to a short length. The stitch is weak so that it will break after imposing an intermediate resistance force which causes extension of the deflator device. This feature is not needed with non-extendable deflators and where the distance from the deployment point to the target area is relatively fixed.

Another aspect of my invention resides in a method of deploying a tire deflator from a moving vehicle. The method, broadly defined, comprises the steps of providing a law enforcement vehicle with a suitably mounted deflator, driving the vehicle on a roadway and ejecting the deflator laterally of the vehicle onto and across an adjacent section of roadway.

Still another aspect of my invention is to provide a remote actuator for deploying a tire deflator. This aspect allows an operator to deploy a deflator from a safe, remote location.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE ILLUSTRATIVE EMBODIMENT

Figure 1:
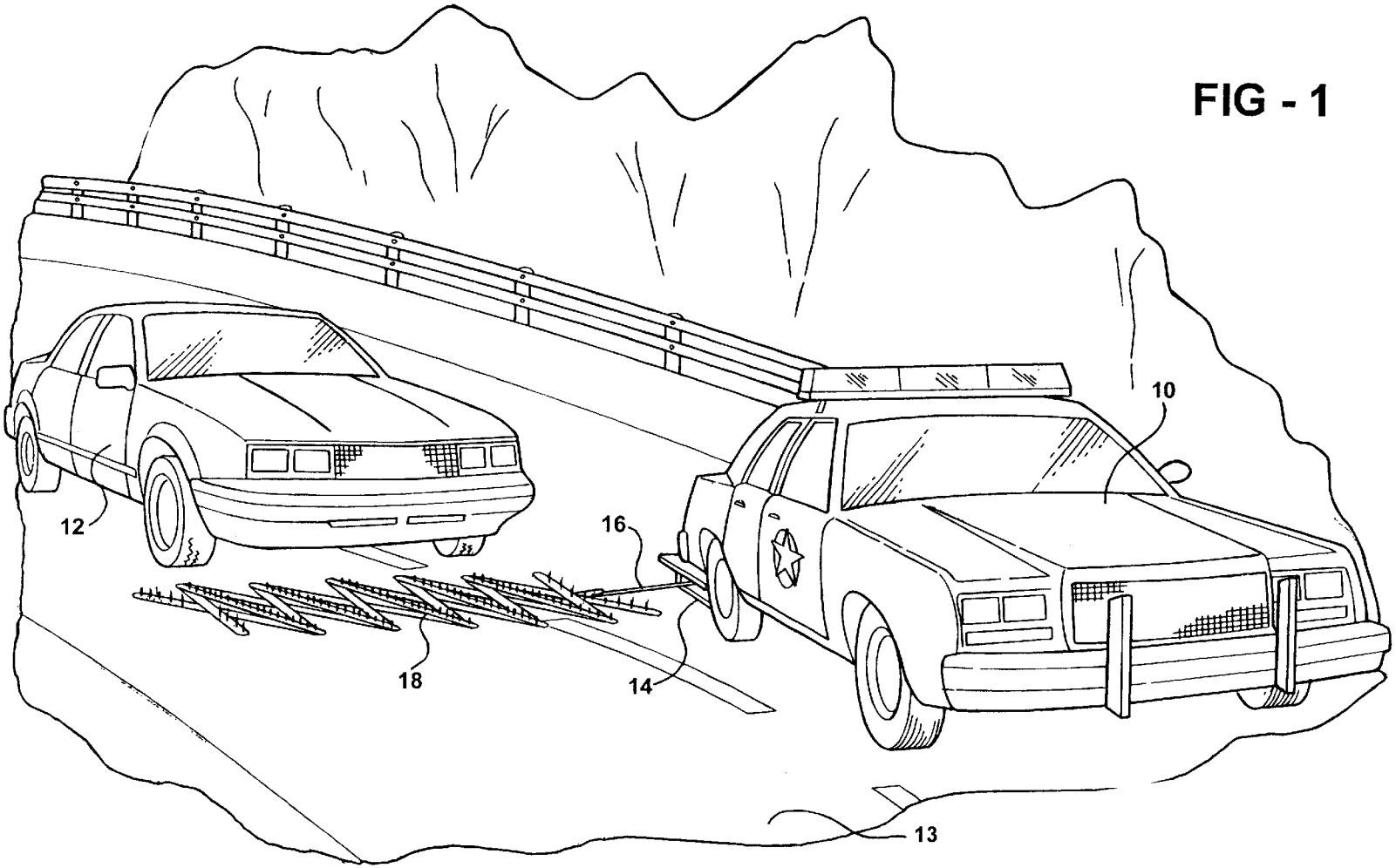
FIG. 1 shows a law enforcement vehicle deploying a tire deflator in front of a target vehicle.

FIG. 1 illustrates a law enforcement vehicle 10 in front of and in the adjacent lane from a target vehicle 12 on a roadway 13. The law enforcement vehicle 10 is equipped with a housing 14 from which a collapsible-type tire deflator 18 has been deployed. The deflator 18 is connected to the vehicle 10 by a tether 16. The relative positions of the vehicles 10 and 12 are such as to cause the deflator to extend across the lane of roadway 13 in front of the target vehicle 12. In this state it is nearly impossible for the target vehicle to avoid driving over the deflator 18. After the deflator spikes have penetrated the tires of the target vehicle 12, the tire deflator 18 trails behind the law enforcement vehicle 10, allowing easy recovery and minimizing the danger that the tire deflator might create unintended damage to another vehicle.

Figure 2:
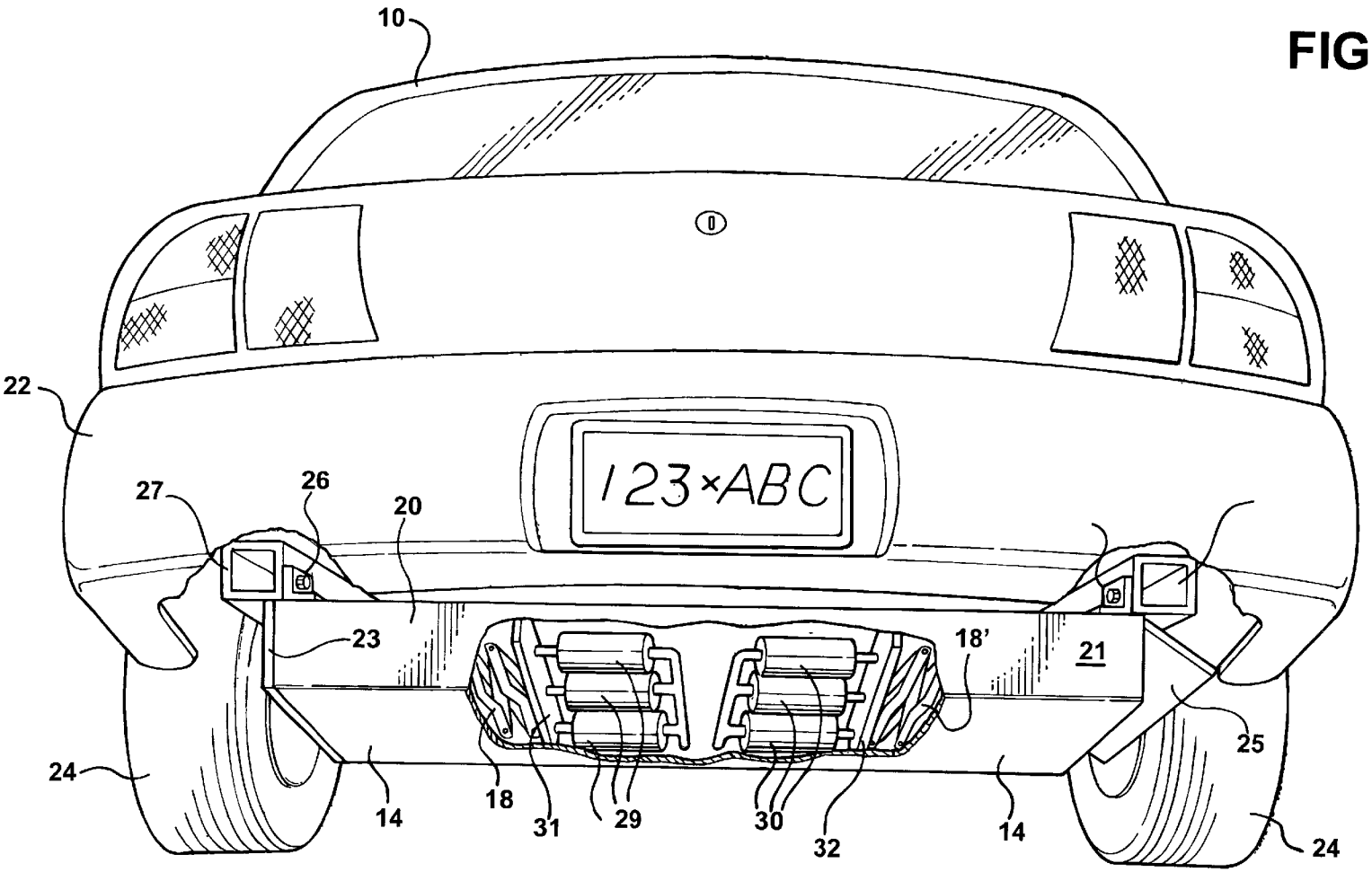
FIG. 2 shows a dual-direction deployment system mounted on the underside of a law enforcement vehicle.

FIG. 2 shows detail of a system for the selective deployment of a tire deflation device mounted on the underside of a law enforcement vehicle 10. The system comprises a housing 14 mounted with brackets 26 to the frame 27 on the underside of the law enforcement vehicle 10. Once mounted, the apparatus is located behind the rear tires 24 of the law enforcement vehicle 10 and just ahead of the rear bumper 22. Housing 14 has left and right compartments 20 and 21 with springbiased hinged doors 23 and 25 respectively. Power for deployment is provided by air cylinders 29 and 30 arranged in opposing banks for left and right deployment. Mounting the deflator housing 14 to the underside of the vehicle, while preferred, may be impossible or disadvantageous for some types of vehicles. The housing may be mounted to or on the rear deck of the vehicle 10 or incorporated into the bodywork of the vehicle such that the deflator 18 resides inside the trunk or other interior area of the vehicle 10.

Cylinder banks 29 and 30 are attached to flat pushers 31 and 32 respectively which act directly on the stored tire deflators 18 and 18 to propel them from their respective compartments when they are selected for deployment by means hereinafter described. The force of the exiting deflator opens the door 23 or 25.

Figure 3:
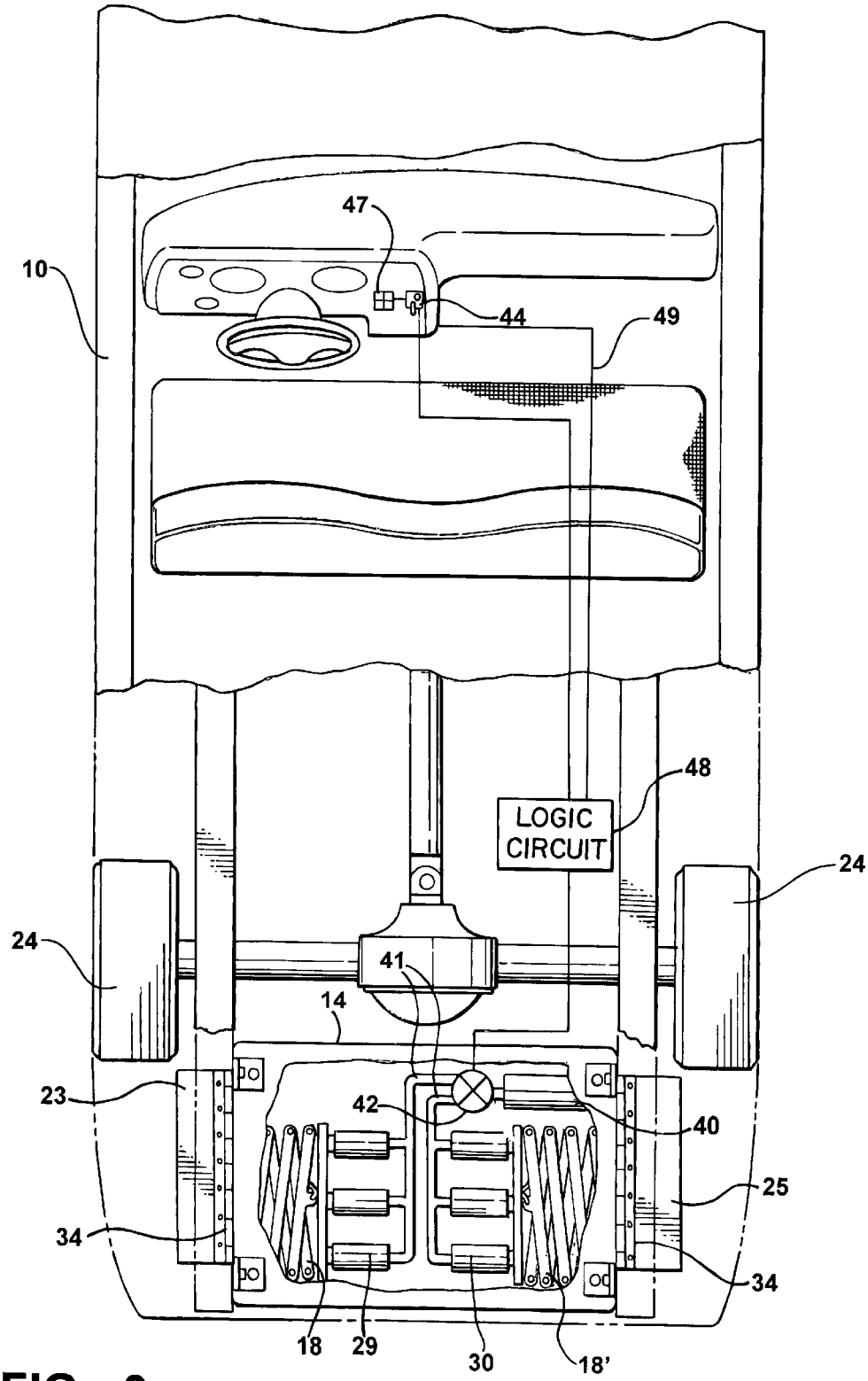
FIG. 3 depicts an overhead partially sectioned view of the invention in a law enforcement vehicle with dash-mounted arming and firing switches.

FIG. 3 is an overhead partially sectioned view of the invention mounted to a law enforcement vehicle 10. The collapsed tire deflation devices 18 and 18' are shown within the housing 14. The housing 14 is preferably made of plastic and the doors are sealed to protect the tire deflation device 18 from the weather. The doors 23 and 25 have hinges 34 on the upper edge that attach to the housing 14. Upon ejection, the tire deflation device 18 or 18'push against the hinged door and cause the door to open upward and outward as indicated in FIGS. 1 and 2. The housing 14 preferably has a number of inwardly raised ridges (not pictured) located on the top inside surface of the housing 14 running perpendicular to the hinged doors 23 and 25. The ridged surface (not pictured) runs in between the rows of spikes extending upwardly from the top surfaces of the tire deflation devices 18. This helps to stabilize the tire deflations devices 18 inside the housing 14 until it is time for deployment. A portable tire deflator having the desired interior structure is described in U.S. Pat. No. 5,253,950 the disclosure of which is incorporated herein by reference.

Cylinder banks 29 and 30, each having three ejection cylinders, are located adjacent to and perpendicular to the inside walls of the housing 14. In the unextended position, the cylinder output rods are retracted into the ejection cylinders 29 and 30. During ejection, the ejection rods move horizontally toward the hinged doors 23 or 25. The amount of force required to eject the tire deflator device will vary depending on how my invention is incorporated through a particular embodiment. However, for my preferred embodiment, I calculate the amount of force needed to project the tire deflator device 15 feet to be on the order of 480 lbs/ $sec^2$. This was calculated by using the equation $s=\frac{1}{2}at^2$, with s representing the distance, a representing acceleration, and t representing time. Choosing a time of 0.50 seconds and a distance of 15 feet, acceleration (a) is equal to 60 ft./$sec^2$. To calculate force the equation f=ma is used where m is equal to the mass of the tire deflation device and a is equal to acceleration which was just calculated. The mass of the tire deflation device is approximately 8 lbs which is multiplied by the acceleration (60 ft/$sec^2$) to get a calculation of the amount of force needed to be applied to eject the tire deflation device. Solving for force it becomes apparent that the amount of force needed to eject the tire deflator is 480 ft/lbs/$sec^2$. These calculations are not intended to be limiting in any way as other engineering calculations will be required for other systems.

The cylinders 29 and 30 are powered by a compressed gas cylinder 40 that is electrically attached to a three way control valve 42 that is selective between one of two outlets to achieve either left or right side deployment. When the threeway valve opens, the gas from the gas cylinder 40 is released into one of the sets of the air lines 41 to power the ejection cylinders 29 or 30 to propel the selected deflator.

Figure 6:
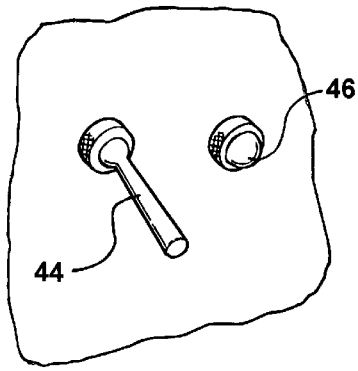

To activate the system, a master switch 44 located on the dashboard is switched "on". As shown in FIG. 6, moving the toggle switch 44 upwardly arms the system and activates a red indicator light 46. When the "firing" switches 47 are thereafter pressed, a signal is sent to a logic circuit 48 which signals the three-way control valve 42 to open and allow the compressed gas cylinder 40 to release the gas to deploy either the left or right side deflator.

Logic circuit 48 is conventional AND-type circuitry for generating an encoding output only when both inputs are high. It may be used to perform other logic functions; e.g., a transmission condition signal line 49 can be used to disable the system when the law enforcement vehicle is in PARK.

Figure 4:
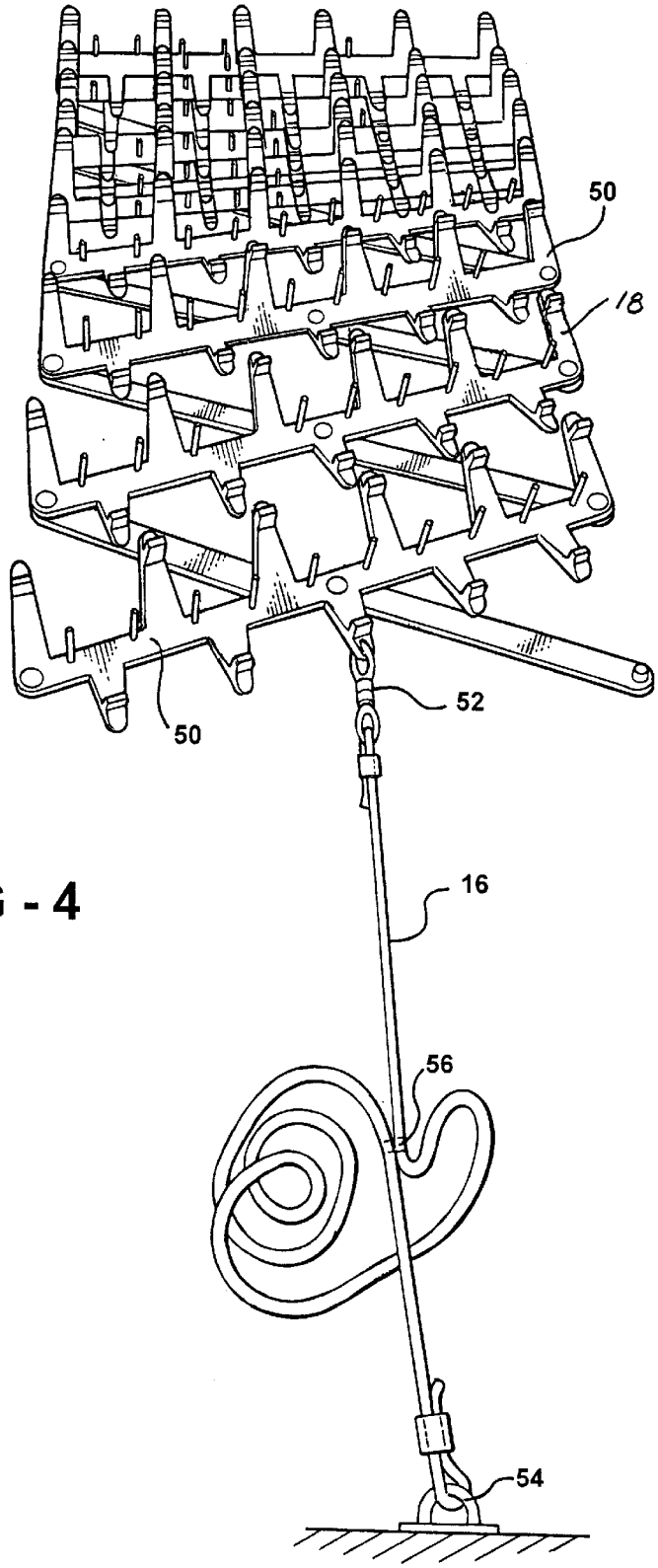
FIG. 4 is a perspective view of a collapsible tire deflation device partially extended with a tether line attached.

FIG. 4 shows the tire deflation device 18 partially extended with the tether line 16 attached. The tire deflation device 18 has an upper spiked surface 50 that faces upward and a smooth flat undersurface which engages the roadway when deployed. A tether line 16 attaches to the tire deflation device 18 by a swivel link 52 and to a hook 54 on the inside wall of the housing. In order to provide an intermediate resistive force so that the tire deflator 18 will extend immediately after ejection, the tether line 16 is coiled and stitched at 56. Upon ejection the shortened tether line 16 is extended and briefly imposes a resistive force so that the tire deflation device 18 is extended, the tension created causes the stitch 56 to break and the tether line 16 uncoils to full length.

Figure 5:
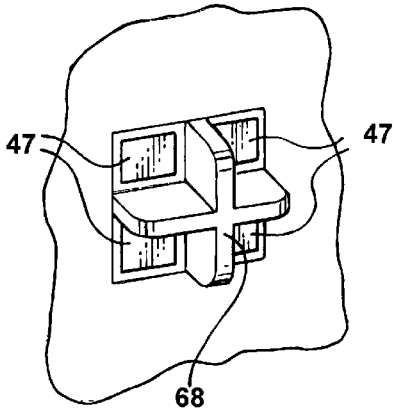
FIGS. 5 and 6 show control switches used to operate the system in the vehicle embodiment.

FIGS. 5 and 6 depict the control switches that operate the system in the vehicle embodiment. A toggle switch 44 is used to arm the system. A "firing" switch 47 has four buttons that control either left or right side of ejection. The two right side buttons control right side deployment while the two left buttons control left side deployment. In order to deploy either the right or left side tire deflator (not shown), the operator must press both right side buttons or both left side buttons in sequence or simultaneously. In order to avoid accidental ejection of the tire deflator this particular control panel 46 has a raised divider 68.

Operation of Mobile Embodiment

Figure 8:
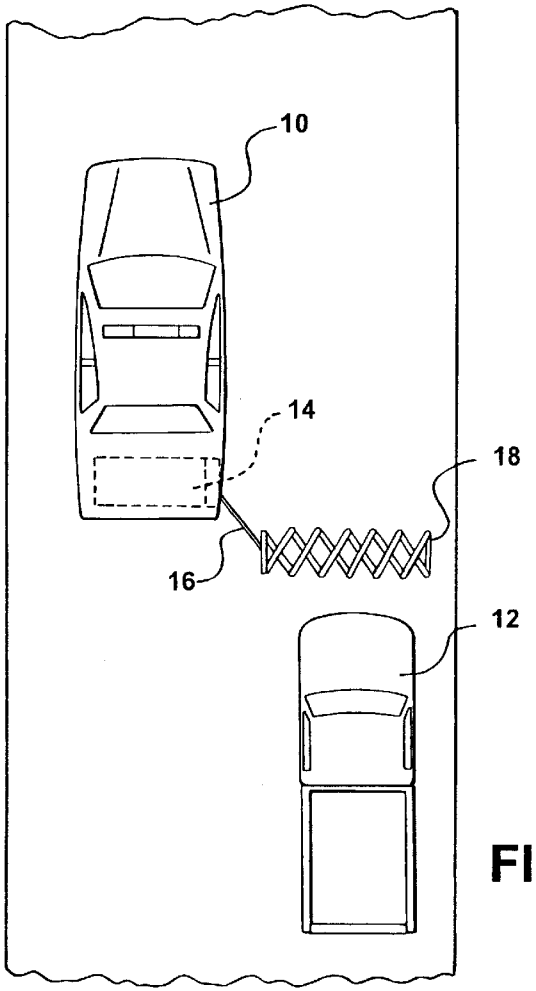
FIG. 8 shows the law enforcement vehicle after it has overtaken the target vehicle and has deployed the deflator.
Figure 7:
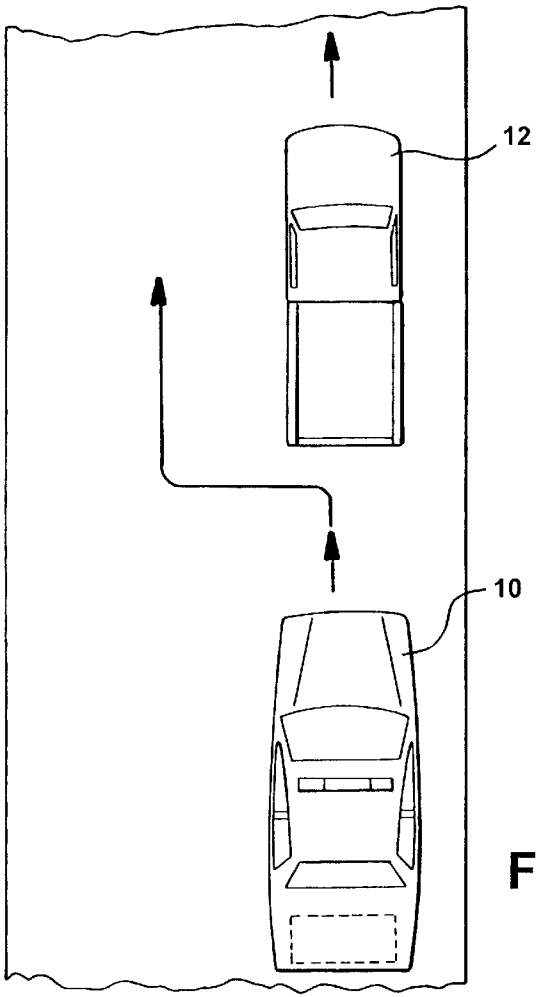
FIG. 7 is an overhead view of a law enforcement vehicle in pursuit of a target vehicle.

FIG. 7 depicts a law enforcement vehicle 10 in pursuit of a target vehicle 12. Both vehicles are traveling in the same direction. As shown in FIG. 8, the law enforcement vehicle 10 accelerates ahead of the target vehicle 12. Once in this position, the operator in the law enforcement vehicle 10 deploys the tire deflator 18 from the housing 14 directly in front of the target vehicle 12. The target vehicle 12 drives over the tire deflator 18 and at least some of its tires are punctured and deflated. A tether line 16 is attached to the tire deflator 18 and connected to the housing 14 to facilitate recovery of the tire deflator 18.

Stationary Embodiment

Figure 9:
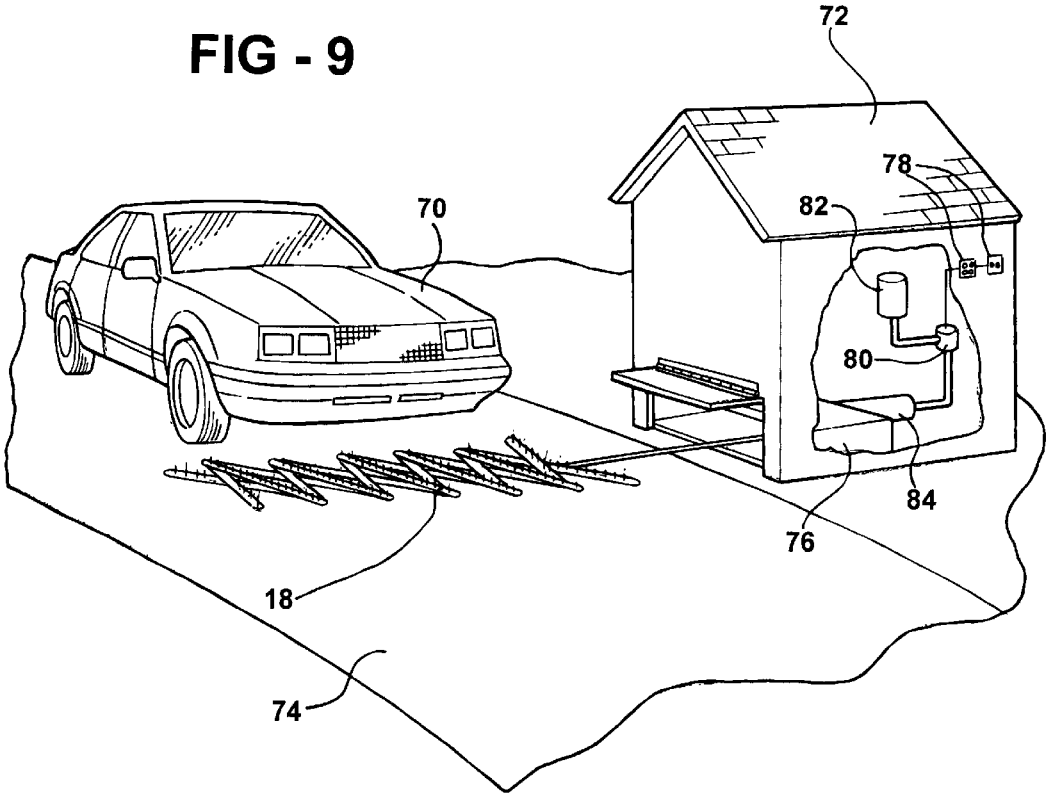
FIG. 9 is a perspective view of the invention mounted in a stationary structure.

My invention can also be incorporated in a stationary structure such as a tollbooth or other security checkpoint. FIG. 9 depicts this embodiment. When a target vehicle 70 approaches a tollbooth 72, a tire deflation device 18 can be deployed laterally across the adjacent lane 74. In this embodiment, a housing 76 is located at the base of the stationary structure 72. Outside the housing 76 is a tire deflation device 18 that has been deployed and extended across the lane in front of an approaching target vehicle 70. The system control switches 78 are located inside the tollbooth 72 and control the opening and closing of a valve 80 that controls the flow of air from the compressed gas cylinder 82 to the ejection cylinder 84.

The stationary embodiment can exist as a single system as depicted in FIG. 9 or as a dual embodiment. The dual embodiment uses the same type of dual system in one housing similar to the system described in the vehicle embodiment. This is ideal for stationary structures that are located in the middle of two roadways that are both monitored by the single structure.

Variations of the Apparatus

While I prefer the collapsible deflator, my invention can be used with other types of deflators such as the device described in U.S. Pat. No. 5,820,293 issued on Oct. 13, 1998 to Louis M. Groen, Kenneth J. Greves and Richard B. Linnemann.

Although a particular type of propulsion means is disclosed, it will be understood and appreciated by those skilled in the area of propulsion art that various different propulsion mechanisms may be used. One alternative means of propulsion is an inflation gas generator described in U.S. Pat. No. 5,645,296 issued on Jul. 8, 1997 to Takeshi Okada, Michio Sioda and Takasi Minamizawa. Another method for propulsion that could be incorporated is a spring mechanism like the one incorporated in U.S. Pat. No. 5,839,849 issued on Nov. 24, 1998 to David R. Pacholok and Charles A. Kuecker. Still another type uses an explosive charge similar to that used to inflate automotive air bags.

Figure 10:
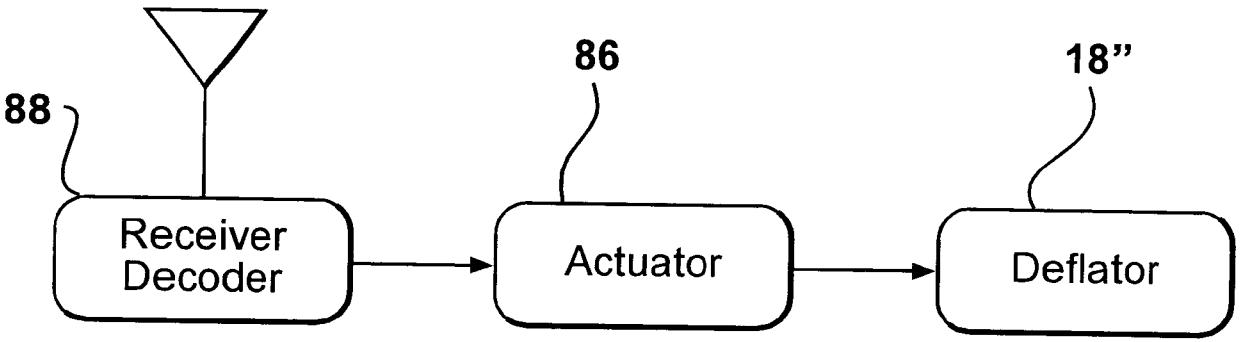
FIG. 10 is a block diagram of a remote actuator system.
Figure 10:
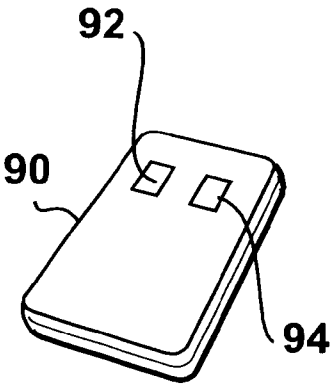

Another variation is shown in FIG. 10 to use a wireless remote actuator 86 to trigger deployment of a tire deflator 18". An RF receiver 88 receives signals from a two-button transmitter 90 to enable the actuator as previously described. The two buttons 92, 94 are logically combined as described above with references to FIG. 3 so that inadvertent actuation of the deflator 18" is avoided. The transmitter 90 and receiver 88 employ RF technology of the type currently used to control garage door operators. The remote deployment system can be used with either stationary or mobile embodiments. In the case of the mobile embodiment, the logic circuit 48 is configured to enable remote deployment even if the vehicle 10 is in PARK. This permits law enforcement officers to park a vehicle equipped with my invention in the desired location beside a roadway, remove themselves from the immediate vicinity, and still deploy the deflator when a target vehicle approaches.

What is claimed is:

1. A system for the selected deployment of a tire deflator comprising:

a housing for receiving and storing a tire deflator, the housing having a door;

a deflator disposed within the housing adjacent the door;

mechanical propulsion means operative to push the deflator out of the housing through the door and onto an adjacent roadway while disconnecting from the deflator;

means for selectively actuating the propulsion means; and a tether connecting the deflator to the housing and operative after disconnection to limit the extent of lateral movement of the deflator across the adjacent roadway.

2. The system of in claim 1 wherein the deflator is collapsible.

3. The system of claim 1 wherein the propulsion means is of the compressed gas type.

4. The system of in claim 1 wherein the housing is mounted or in a vehicle.

5. The system of claim 1 wherein the means for actuating comprises a remote transmitter and a receiver.

6. A system for the selective deployment of a road vehicle tire deflator comprising:

a tire deflator having a collapsed condition and an extended condition, the tire deflator further having a flat, road engaging side and a spiked tire deflator side;

a storage housing for receiving and securing the deflator in the collapsed condition with the spiked, deflator side facing upward;

a selectively actuable power source for pushing the collapsed deflator out of the housing onto an adjacent roadway while disconnecting from the deflator;

a tether connecting the deflator to the housing and operative after disconnection to limit the lateral movement of the deflator across the roadway and cause movement of the deflator from its collapsed condition to its extended condition; and trigger means for actuating the power source.

7. The system of claim 6 wherein the housing is mounted to the rear underside of a law enforcement vehicle.

8. The system of claim 6 wherein the housing is mounted to the base of a stationary structure located adjacent to a roadway.

9. The system of claim 6 wherein the power source comprises a compressed air tank.

10. A system for the selective deployment of a road vehicle tire deflator comprising:

a tire deflator having a collapsed condition and an extended condition; the tire deflator further having a flat, road engaging side and a spiked tire deflator side;

a storage housing for receiving and securing the deflator in the collapsed condition with the spiked, deflator side facing upward;

selectively actuable power source for ejecting the deflator from the housing onto and laterally across a roadway;

means for restraining one end of the deflator after ejection thereby to cause extension thereof across the roadway;

trigger means for actuating the power source;

a master switch with a setting for "on" or "off" and an LED light that illuminates when the "on" setting is selected;

two deployment switches connected to the master switch;

a logic circuit connected to the deployment switches;

a control valve connected to the master switches;

the control valve having an "on" position and a "off" position; and a compressed gas tank connected to the control valve.

11. A method for the selective deployment of a tire deflation device including a housing mounted to the underside of a vehicle with a hinged door, a collapsed tire deflator with a tether line attached, at least one ejection rod associated with an ejection cylinder, a gas line connecting to the ejection cylinder, a control valve, a compressed gas tank, a logic switch connected to the control valve, a set of deployment switches connected to the logic switch and a master switch connected to the deployment switches, method comprising the steps of:

moving the master switch to the on position;

activating the deployment switches, to send a signal to the logic circuit;

the logic circuit sending a signal to open the control valve;

gas flowing from the compressed gas tank into the gas line;

the gas flowing from the gas lines into the ejection cylinders;

rising pressure in the ejection cylinders causing the ejection rods to move outward and push against the tire deflation device;

the tire deflation device causing said hinge door to open outward and upward from the housing;

the tire deflator leaving the housing with the tether line attached at one end to the tire deflator and other end to the housing; and the tire deflator extending outside said housing.

12. A method of deflating the tires of a target vehicle moving forwardly in a roadway traffic lane comprising the steps of:

positioning a pursuing forwardly moving vehicle in an adjacent roadway traffic lane and forwardly of the target vehicle; and ejecting a deflator device laterally from the pursuing vehicle onto the roadway traffic lane of the target vehicle whereby to deflate the tires of the target vehicle.

13. A system for the selective deployment of a road vehicle tire deflator comprising:

a tire deflator having a collapsed condition and an extended condition; the tire deflator further having a flat, road engaging side and a spiked tire deflator side;

a storage housing for receiving and securing the deflator in the collapsed condition with the spiked, deflator side facing upward;

a selectively actuable power source for ejecting the deflator from the housing onto and laterally across a roadway;

means for restraining one end of the deflator after ejection, thereby to cause extension thereof across the roadway;

trigger means for actuating the power source;

the system comprising a dual system in one housing positioned adjacent and laterally to each other with ejection of the tire deflation devices occurring in opposite directions.

14. A method of stopping a moving vehicle by placing a tire deflator in the path of the vehicle comprising the steps of:

placing a tire deflator on a pursuit vehicle in a depolyable state;

maneuvering the pursuit vehicle into a position near the moving vehicle and ahead of at least some of the tires of the moving vehicle; and deploying the tire deflator from the pursuit vehicle into the path of at least some tires of the moving vehicle.

15. A method as defined in claim 14 including the further step of tethering the tire deflator to the pursuit vehicle.

16. A pursuit vehicle mounted system for disabling a moving vehicle comprising:

a mounting structure disposed on the rearward underside of the pursuit vehicle for receiving a tire deflator in a deployable state.

a tire deflator disposed in said mounting structure; and an actuator for deploying the deflator from and away from the pursuit vehicle into the path of a target at least a portion of which is behind the pursuit vehicle.

17. A system as defined in claim 16 further including a tether attaching the tire deflator to the pursuit vehicle.

18. A system as defined in claim 17 wherein the tether includes frangible means for incrementally measuring the length of the tether in response to tension.

* * * * *